US009743692B2

(12) United States Patent
Palese et al.

(10) Patent No.: US 9,743,692 B2
(45) Date of Patent: Aug. 29, 2017

(54) COMPRESSION BANDS, GARMENTS AND RELATED METHODS

(71) Applicants: Jill Elizabeth Palese, Hingham, MA (US); Kerri Rae Simons McDonough, Livingston, NJ (US)

(72) Inventors: Jill Elizabeth Palese, Hingham, MA (US); Kerri Rae Simons McDonough, Livingston, NJ (US)

( * ) Notice: Subject to any disclaimer, the term of this patent is extended or adjusted under 35 U.S.C. 154(b) by 55 days.

(21) Appl. No.: 14/684,025

(22) Filed: Apr. 10, 2015

(65) Prior Publication Data

US 2016/0015089 A1 Jan. 21, 2016

Related U.S. Application Data

(60) Provisional application No. 61/977,697, filed on Apr. 10, 2014.

(51) Int. Cl.

| | |
|---|---|
| ***A41C 1/00*** | (2006.01) |
| ***A41C 1/10*** | (2006.01) |
| ***A41C 1/12*** | (2006.01) |
| ***A41C 5/00*** | (2006.01) |
| ***A41D 1/20*** | (2006.01) |

(52) U.S. Cl.

CPC ..... *A41C 1/10* (2013.01); *A41C 1/12* (2013.01); *A41C 5/00* (2013.01); *A41D 1/20* (2013.01); *A41D 2400/38* (2013.01)

(58) Field of Classification Search

CPC ..... A41D 13/06; A41D 1/18; A41D 15/002; A41D 1/06; A41D 1/16; A41B 9/10; A41B 13/06

USPC ..... 2/69, 105, 26, 238, 237, 220, 221

See application file for complete search history.

(56) References Cited

U.S. PATENT DOCUMENTS

| | | | | | |
|---|---|---|---|---|---|
| 416,022 | A * | 11/1889 | Way | A41D 1/16 | 2/217 |
| 709,862 | A * | 9/1902 | Baughman | A41D 1/16 | 2/217 |
| 2,349,019 | A * | 5/1944 | Terrell | A41F 9/025 | 2/221 |
| 2,446,209 | A * | 8/1948 | Brown | A41D 1/18 | 2/105 |
| 2,502,314 | A * | 3/1950 | Donin | A41D 1/18 | 2/106 |
| 2,687,530 | A * | 8/1954 | Farnum | A41B 9/10 | 2/217 |
| 5,367,709 | A * | 11/1994 | Teasley | A41D 15/002 | 2/69 |
| 6,817,033 | B2 * | 11/2004 | Bailey | A41B 13/06 | 2/69.5 |

(Continued)

*Primary Examiner* — Gloria Hale

(74) *Attorney, Agent, or Firm* — J. Bennett Mullinax, LLC

(57) ABSTRACT

Compression bands, garments and related methods are provided herein. More specifically, the subject matter disclosed herein relates to compression bands that can be used in compression garments that have multidimensional features and methods related to the compression bands and garments. The compression bands can comprise a supportive back portion having a first side end and a second side end and a front panel secured along side seams to the first and second ends of the supportive back portion that. Depending on the construction of the compression band and its use, support can be provided to portions of a body of a wearer.

19 Claims, 14 Drawing Sheets

(56) References Cited

U.S. PATENT DOCUMENTS 6,859,944 B2 * 3/2005 Kim ..... A41D 1/06
2/237

* cited by examiner

COMPRESSION BANDS, GARMENTS AND RELATED METHODS

RELATED APPLICATION

The presently disclosed subject matter claims the benefit of U.S. Provisional Patent Application Ser. No. 61/977,697, filed Apr. 10, 2014, the disclosure of which is incorporated herein by reference in its entirety.

TECHNICAL FIELD

The subject matter disclosed herein relates to compression bands, garments and related methods. In particular, the present subject matter relates to compression bands that can be used in compression garments that have multidimensional features and methods related to the compression bands and garments.

BACKGROUND

Even the smoothest of pregnancies often come with aches and pains. Common pregnancy aches and pains can include pelvic pain or discomfort and back aches and pains. For example, a pregnant woman may start to experience sciatic pains associated with the pelvic region. Sciatic pains can be caused by the weight of the rapidly growing baby creating pressure on the nerves that run to her legs in her pelvic region. Similarly, the weight of the rapidly growing baby can change her posture such that the sciatic nerve becomes compressed. Additionally, toward the end of her pregnancy, she may experience a surge in the hormone relaxin that can cause pain and discomfort in her pelvic joints.

According to the American College of Obstetricians and Gynecologist, back pain is one of the most common discomforts for a mother-in-the-waiting. Such back pains are also commonly caused by the added weight of the growing baby, her changing center of gravity, and the shifting of her internal organs, all of which can throw her body off balance. As she changes her posture to compensate, a strain can be placed on her back. Further, the abdominal muscles that support her back can be weakened and can be challenged by the extra weight. Thereby, her compensation in response to her changing body can lead to over-arching of her lower back or rounding forward of her upper back and head, which, in turn, can lead to back problems.

Providing strategy abdominal support to a woman during and after her pregnancy can aid in alleviating these pains and their causes. Such needed support may change as the pregnancy progresses in both amount and in the location of the needed support.

At the same time, many women who are pregnant would like to continue to wear stylish clothes during their pregnancy. Having an under garment or outer garment that helps to slim the figure and support the abdomen of a pregnant woman can help her to possibly broaden her available wardrobe. Additionally, for a style-conscious woman, such a garment can provide the woman with a more blemish-free look under her clothes which also provides the possibility of broadening her available wardrobe. Additionally, having an outer garment that slims the figure and supports the abdomen can also be beneficial.

Therefore, a need exists for garments that can provide needed and selective support to different portions of a woman's body, including her back and abdomen and that can increase her wardrobe options during the different stages of pregnancy and post-pregnancy.

SUMMARY

It is an object of the present disclosure to provide novel compression bands, garments and related methods of making and/or using the same. More specifically, the subject matter disclosed herein relates to compression bands that can be used in compression garments that have multidimensional features and methods related to the compression bands and garments.

While a few objects of the presently disclosed subject matter have been stated hereinabove, which can be achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter to one of ordinary skill in the art is set forth more particularly in the remainder of the specification and in the other documents, pictures and figures attached herewith, including reference to the accompanying figures in which.

DETAILED DESCRIPTION

Figure 1:
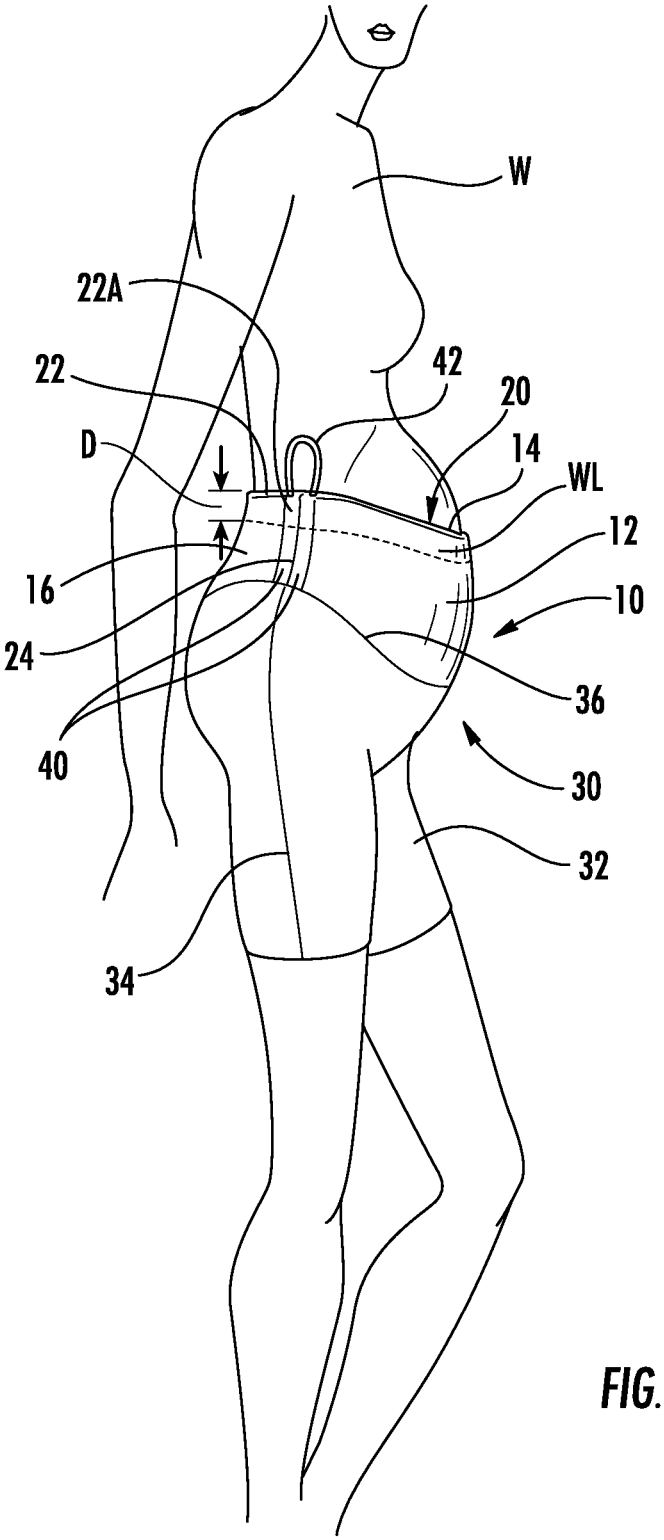
FIG. 1 illustrates a side view of an embodiment of a compression garment that can comprise an embodiment of a compression band with the compression band in an extended position as worn on a wearer according to the subject matter disclosed herein.

Reference will now be made in detail to the description of the present subject matter, one or more examples of which are shown in the pictures and figures. Each example is provided to explain the subject matter and not as a limitation. In fact, features illustrated or described as part of one embodiment may be used in another embodiment to yield still a further embodiment. It is intended that the present subject matter cover such modifications and variations.

Although the terms first, second, right, left, front, back, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Similarly, in the present disclosure, when a feature, element, component, region, layer and/or section is being described as "top", "bottom," "front," "rear," "side," etc., it should be understood that such terms are relative and not absolute. Thus, something that is described with the adjective of "top" may also be considered on a side or a bottom depending on the orientation of the larger subject being described. Additionally, when a feature, element, component, region, layer and/or section is being described as "under," "on," or "over" another feature, element, component, region, layer and/or section, it is to be understood that the features, elements, components, regions, layers and/or sections can either be directly contacting each other or have another feature, element, component, region, layer and/or section between the them, unless expressly stated to the contrary. Similarly, directional movement, such as "back and forth," "forward," "backward," "up," "down," or the like are to be understood as relative descriptions that can change depending on the orientation of the subject matter relative to the viewer. Thus, these terms are simply describing the relative position of the features, elements, components, regions, layers and/or sections to each other and do not necessarily mean an absolute position or direction since the relative position above or below depends upon the orientation of the subject matter to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of a compression band and/or compression garment and are not intended to limit the scope of the subject matter disclosed herein.

The subject matter disclosed herein relates to different embodiments of strategically designed compression bands that can be adjustable and that can form a part of, be applied to, or be used in conjunction with a variety of different garment bottoms including undergarments and outer garments. For example, the garments can include, but are not limited to, underpants, support leggings, swimwear, pants, exercise pants, shorts, exercise shorts, skirts, dresses and support shorts as well as other types of inner and outer garments. In some embodiments, the compression band can be attached to, for example, stitched to, any variety of foundation garments, such as, for example, but not limited to, briefs, thong panties, leggings, compression shorts, swimwear, pants, exercise pants, shorts, exercise shorts, skirts, and dresses as well as other types of inner and outer garments. While generally described herein for use in conjunction with women during maternity, it is understood that the compression band and compression garments disclosed herein can be used by women at other stages in their lives and/or by men.

The compression band can cradle the wearer's pregnant belly and support her lower back to accommodate the changing shape of a woman's body throughout the various stages of pregnancy and post pregnancy. The placement of the panels around the wearer's belly circumference can increase the tension and amount of compression over the course of the full pregnancy. For example, in some embodiments, the adjustability of the compression band that can comprise a portion of a compression garment can allow the wearer to utilize the garment during the entire course of her pregnancy with varying degrees of compression and support. In such embodiments, the adjustability can allow the wearer to increase or decrease the amount of stomach covered by the garment by engaging the side seam channel drawstring. The compression garments disclosed herein can minimize the amount of garments that a woman needs to purchase during her pregnancy by combining the functionality of the compression and support panels of the compression bands with a stylish design suitable for a woman who is conscious of style during her pregnancy.

For example, the compression bands and compression garments disclosed herein can comprise multiple panels and/or inserts that can be strategically placed to support the lower back, hip, abdomen and lower abdomen. The compression bands and compression garments disclosed herein can comprise a unique surplice crossover design formed by two front panels. The surplice formed by the two front panels can allow the wearer maximum adjustability in support, coverage and comfort.

The panels can comprise one or more fabrics and/or fabric layers. For example, the panel can comprise one or more elastic fabrics or layers of fabric that can include at least one elastic fabric. For example, the fabrics can be weft knit fabrics or warp knit fabrics. In some embodiments, some of the fabrics used in the panels can be weft knit fabrics, such as circular knit fabrics or flat weft knit fabrics as examples. Some of the fabrics used in the panels can be warp knit fabrics, such as tricot knit fabrics or Milanese knit fabrics as examples. For example, depending on the need being address by the compression band, in some embodiments, the panels can comprise layers of all warp knits fabrics, all weft knit fabrics, or a combination of weft knit fabrics and warp knit fabrics.

In some embodiments, the one or more fabrics and/or fabric layers can comprise one or more knit fabrics that can include one or more elastic fibers or yarns. In some embodiments, for example, one or more of the panels of the compression bands or compression garments can comprise a high performance warp knit that comprises nylon and spandex. For example, the nylon can be nylon sold under the trademark ZYTEL and the spandex can be spandex sold under the trademark LYCRA, both supplied by E. I. Du Pont De Nemours and Company Inc. headquartered in Wilmington, Del. Such a warp knit can exhibit exceptional body moisture management, quick dry, easy care and UV qualities that enhance the wearers comfort while wearing the garment or the band in conjunction with the garment.

Referring to FIGS. 1-6A, an embodiment is provided of a compression band, generally designated 10, that forms a portion of an embodiment of a compression garment, generally designated 30. While the garment 30 is generally shown in use as a maternity garment, it is understood that the compression band 10 and the compression garment 30 can be used by women during other stages of their lives or by men to give added support to their backs and abdomens and/or to slim their figures under their outer garments. The garment 30 can comprise a garment body 32 on which the compression band 10 is attached. For example, compression band 10 can be secured to garment body 32 along a seam 36 to form a top portion of the garment 30. In some embodiments, the compression band 10 can be secured to garment body 32 along a waist seam, represented by seam 36, for example, by stitching. Thereby, the compression band 10 can comprise an upper portion of the garment 30. The garments 30 can comprise any variety of garments or undergarments, including, but not limited to, support leggings, support shorts, swimwear, skirts, shorts, pants, and underpants, such as briefs or thongs. Thus, the garment body 32 can comprise any variety of foundation garments, such as those just mentioned.

The compression band 10 can comprise a plurality of panels 12, 14, 16, 18 that are secured together. The plurality of panels 12, 14, 16, 18 of compression band 10 can comprise one or more fabrics and/or one or more layers as described in more detail below.

For example, the compression band 10 can comprise a first back panel 16 and a second back panel 18 that can be secure together along a seam 26, for example, by stitching to form a supportive back portion 22. The supportive back portion 22 can form side ends 22A, 22B on opposing sides of the band 10. In some embodiments, the supportive back portion 22 can comprise a single compressive panel as explained below.

Figure 6A:
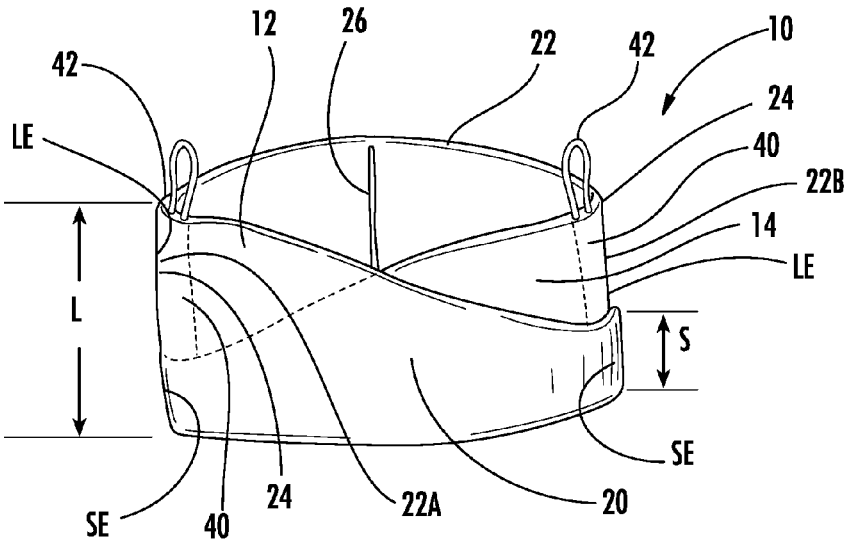
FIG. 6A illustrates a front perspective view of the embodiment of the compression band according to FIG. 1.

The compression band 10 can also comprise a first front panel and a second front panel 12, 14 that can be secured to the ends 22A, 22B of the supportive back portion 22 along seams 24. The front panels 12, 14 can crisscross each other in a front portion of the band 10 and/or garment 30. Thereby, a surplice, generally designated 20, can be formed by the two front panels 12, 14 overlapping at the front of garment 30, for example, at the front of the belly at mid-waist height when the garment 30 is being worn by a wearer W. For example, in some embodiments, each front panel 12, 14 can extend from one end 22A, 22B of the supportive back portion 22 to the other end 22B, 22A of the supportive back portion 22. In some embodiments, each front panel 12, 14 can have a sloping construction so that the length L of one end is greater that the length S of the other end. In this manner, as shown in FIG. 6A, each front panel 12, 14 can comprise a longer end $LE_{12}$, $LE_{14}$ and a shorter end $SE_{12}$, $SE_{14}$ with the longer ends $LE_{12}$, $LE_{14}$ of the front panels 12, 14 connected to opposite ends 22A, 22B of the supportive back portion 22 from each other and the shorter ends $SE_{12}$, $SE_{14}$ of the front panels 12, 14 also connected to opposite ends 22B, 22A of the supportive back portion 22 from each other to form the crisscross construction and the surplice 20.

Figure 4A:
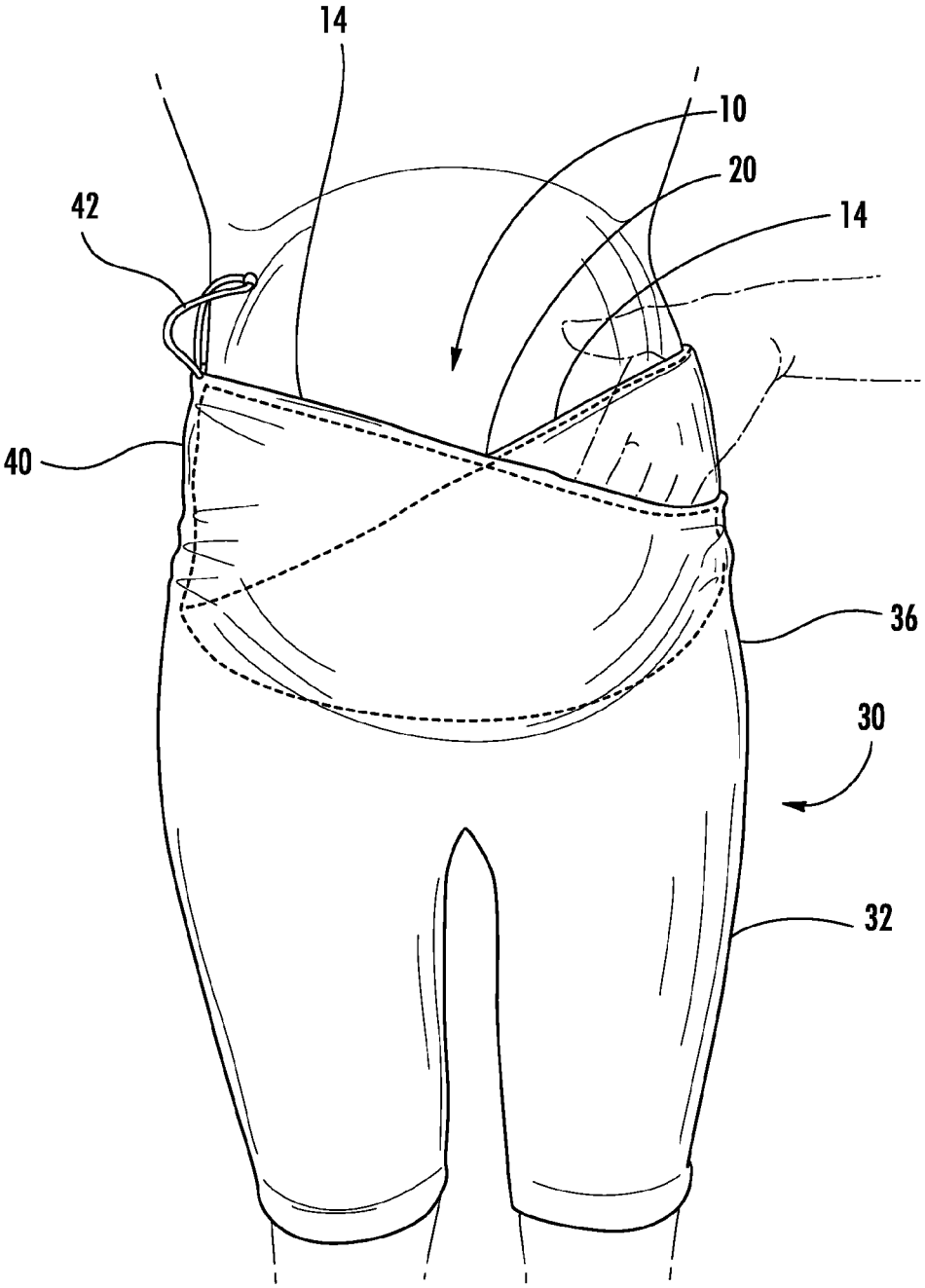
FIG. 4A illustrates front view of the embodiment of the compression garment according to FIG. 1 with the compression band in an extended position as worn on the wearer.
Figure 5A:
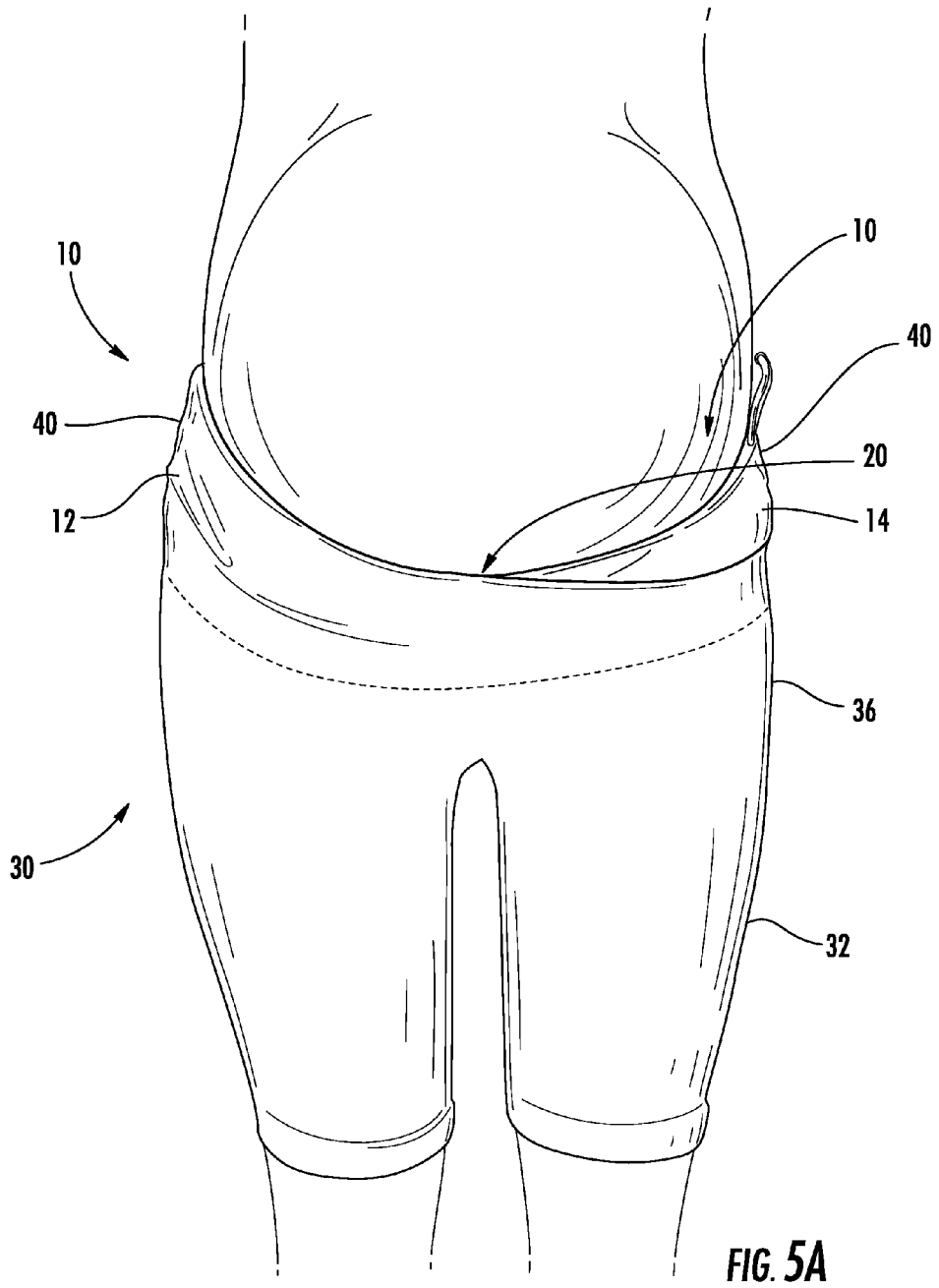
FIG. 5A illustrates front view of the embodiment of the compression garment according to FIG. 1 with the compression band in a cradle position as worn on the wearer.

It is noted that, in some embodiments, the front panels 12, 14 can be not connected to each other at the intersection of the front panels 12, 14. For example, in some embodiments, the front panels 12, 14 can be connected at or near the ends of the supportive back portion 12, 14 as shown in FIGS. 4A, 5A, and 6A. Further, in some embodiments, the front panels 12, 14 can be connected near or along the seam 36 where garment body 32 and compression band 10 are secured together.

Figure 2:
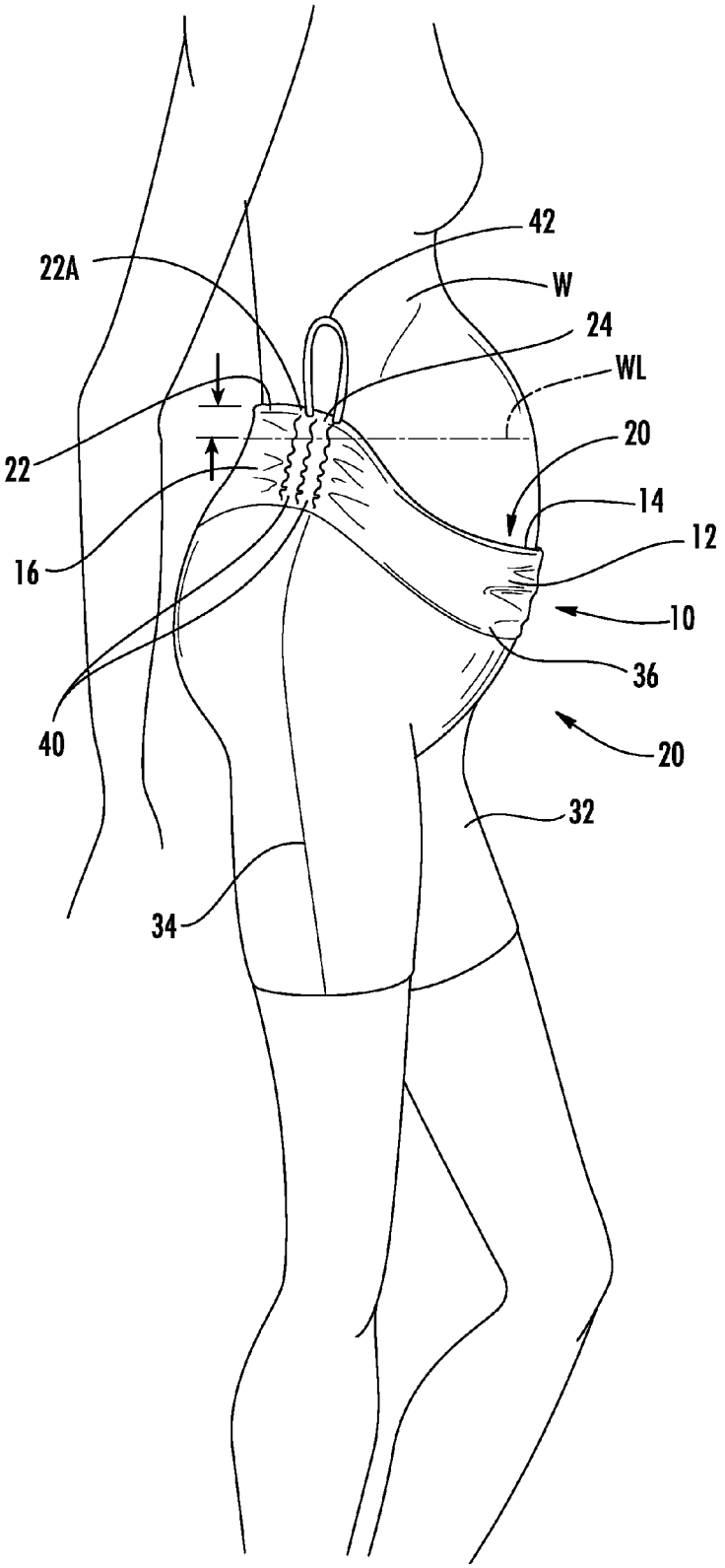
FIG. 2 illustrates the side view of the embodiment of the compression garment according to FIG. 1 with the compression band in a cradle position as worn on the wearer according to the subject matter disclosed herein.
Figure 3:
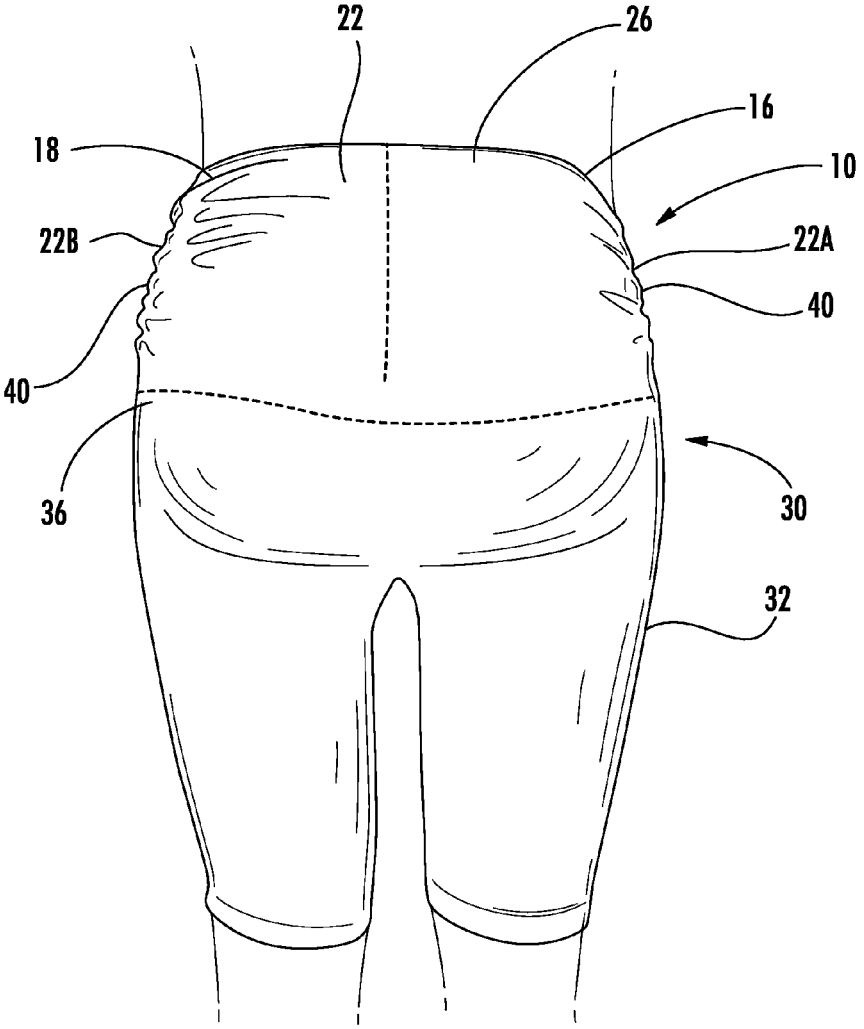
FIG. 3 illustrates a back view of the embodiment of the compression garment according to FIG. 1 showing a supportive back portion of the compression band when the compression band is in a cradle position as worn on the wearer according to the subject matter disclosed herein.

The anatomical placement of the two separate back panels 16, 18 of the compression band 10 shown in FIGS. 1-3 in the supportive back portion 22 can support the mid and lower back of the wearer W and function as a lumbar support. The curved seam 26 (see also FIG. 6A) at the center back that joins the two back panels 16, 18 can follow the shape of the wearer's natural spine curvature for enhanced fit, support and comfort. As the pregnancy progresses and the abdomen grows larger, the tension on the back panels 16, 18 increases, offering the wearer more support.

Figure 4B:
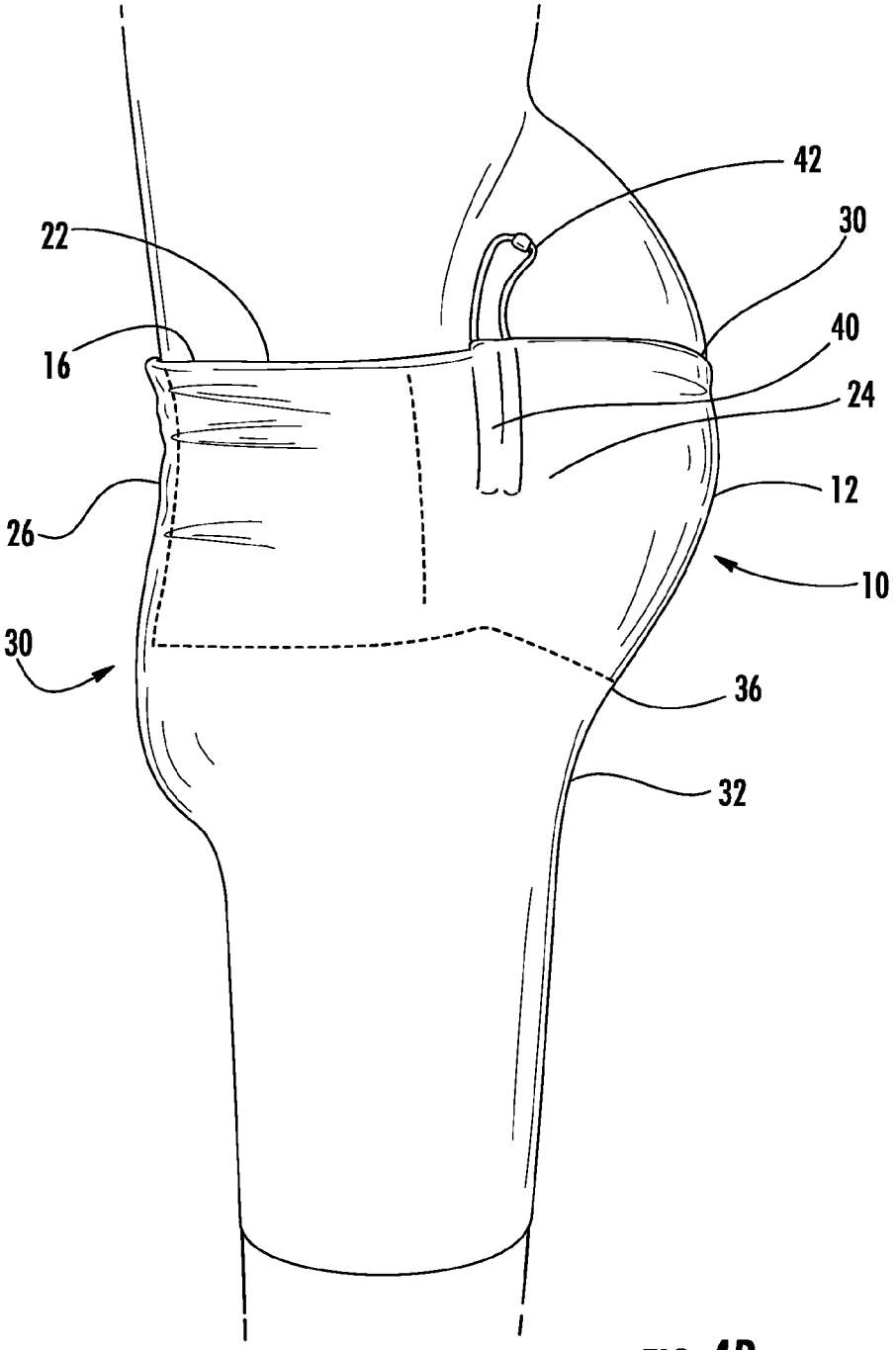
FIG. 4B illustrates another side view of the embodiment of the compression garment according to FIGS. 1 and 4A with the compression band in the extended position.
Figure 5B:
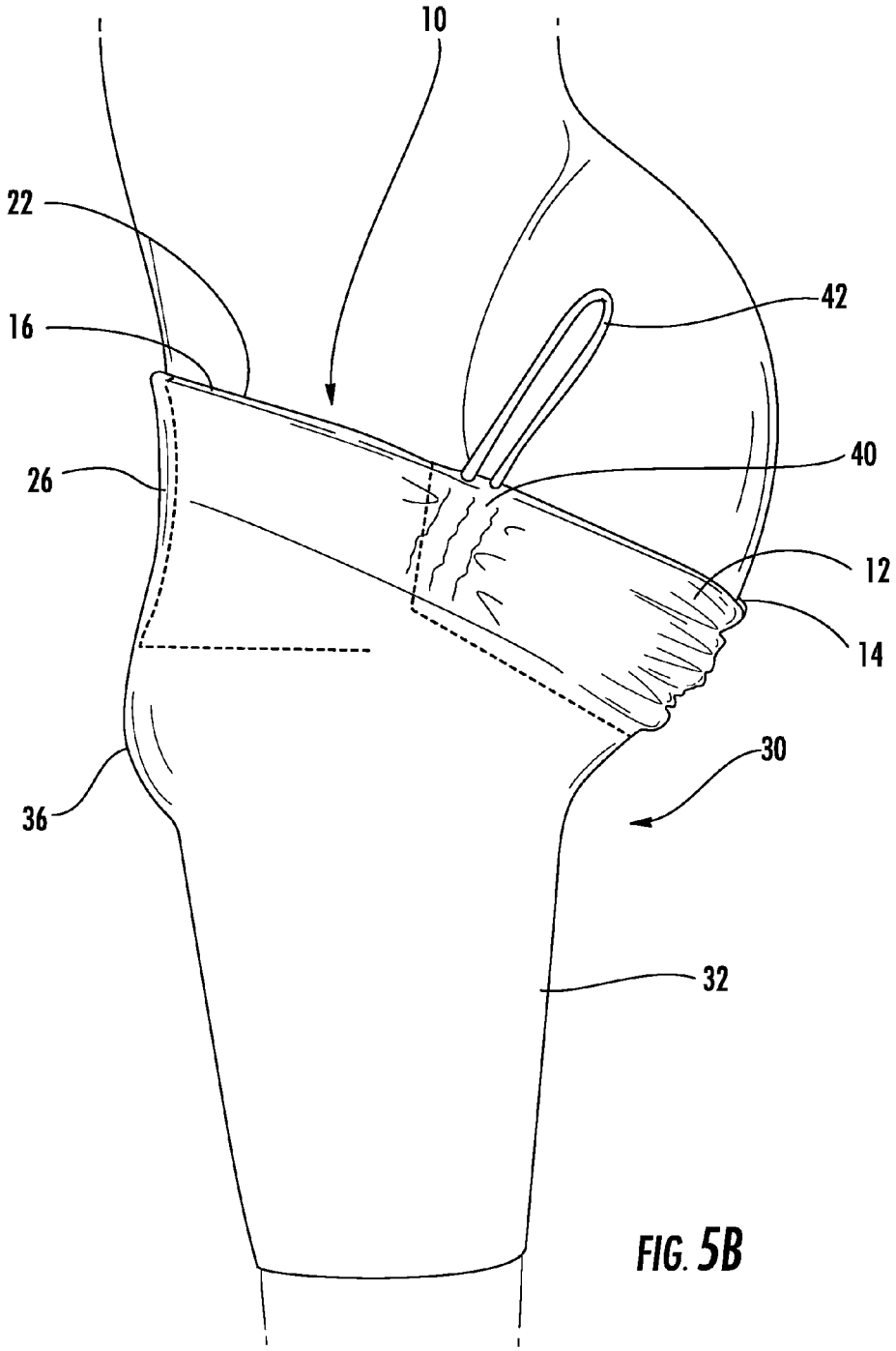
FIG. 5B illustrates another side view of the embodiment of the compression garment according to FIG. 1 with the compression band in the cradle position.

Depending on the type of garment 30, the side seams 24 in some embodiments can align with and/or extend along outseams 34 of the garment body 32. Each side seam 24 between the front panels 12, 14 and the back panels 16, 18 can comprise adjustable draw channels 40 with a drawstring 42 that extends therethrough that can allow the wearer W to choose placement of her surplice 20 of the front panels 12, 14 to meet the needs of her personal comfort, support and fashion sensibilities. For example, the draw channels 40 and the drawstrings 42 can be adjusted relative to one another so that the wearer W can move the band 10, and more particularly, the front panels 12, 14 to an extended position as shown in FIGS. 1, 4A, and 4B or a cradle position as shown in FIGS. 2, 5A, and 5B or any position therebetween that is comfortable and/or desired. When worn completely under the belly, the front panels can act as a sling to cradle the belly with maximum support. When worn over the belly, the front panels can support the circumference of the abdomen of the wearer. The surplice 20 with the adjustability along the sides at the draw channels 40 permit a unique ability for the compression band 10 and the compression garment 10 to provide the desired support and compression along the abdomen of the wearer W at different desired positions. At the same time, the supportive back portion 22 can continue to provide support to the lower back of the wearer W at any position that the surplice 20 and the front panels 12, 14 reside. Thereby, the adjustable draw channels 40 at the side seams 24 allows the wearer W to choose the right amount of support and/or coverage for her own body.

As shown in FIG. 1, the front panels 12, 14 can sit above the natural waistline WL when fully expanded and the surplice 20 of the band 10 is in the full extended position. Similarly, the supportive back portion 22 can also sit above the natural waistline WL. For example, in some embodiments, the supportive back portion 22 can sit at a distance D above the natural waistline WL. The distance D can be between approximately 1 inch and approximately 3 inches in some embodiments. In some embodiments, the distance D can be approximately 1½ inches.

When the drawstrings 42 and channels 40 is fully engaged (i.e., the drawstrings 42 being drawn from the channels 42), the surplice 20 of the band 10 will assume a full cradle position. In the cradle position, the front panels 12, 14 will drop below the belly of the wearer W creating a sling-like cradle for the belly. When the drawstrings 42 and channels 40 is fully engaged and the surplice 20 of the band 10 is in the full cradle position, the side seams 24 can drop to approximately the natural waistline. However, in such embodiments, the supportive back portion 22 can be configured to stay in or near its extended position for maximum lower back and lumbar support even when the surplice 20 of the band 10 is in the full cradle position. Thus, by having the surplice 20 in the front of the garment 30 with the drawstring 42 and draw channels 40 at the side seams 24, the wearer W can fully expand the fabric on the side seams 24 when seeking support and coverage across the entire front of the belly. When the wearer W chooses to expose her belly either as a fashion choice or because her pregnant belly has grown to a stage when the garment 30 can no longer can accommodate the entire belly comfortably, the drawstrings 42 can hold the garment 30 down and under the belly.

Figure 6B:
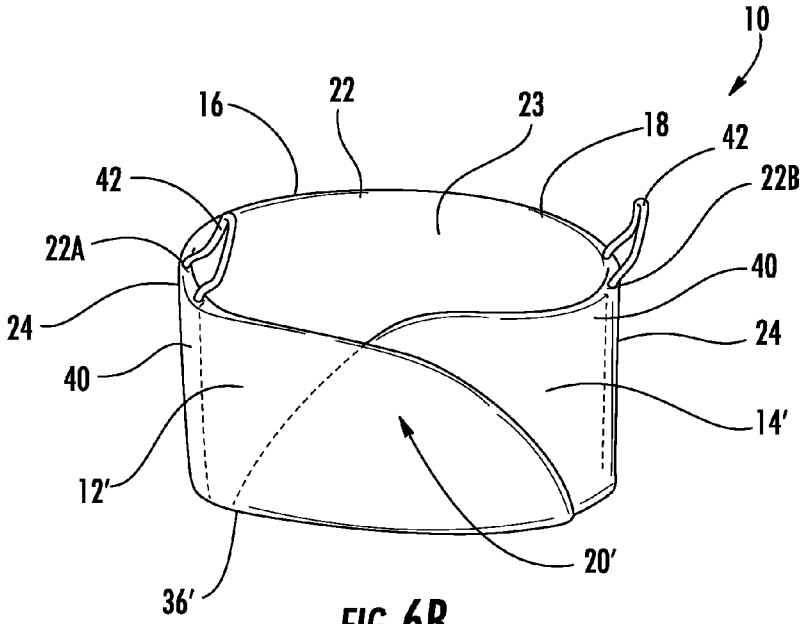
FIG. 6B illustrates a front perspective view of a different embodiment of a compression band with the compression band in an extended position as worn on a wearer according to the subject matter disclosed herein.

Referring to FIG. 6B, a different embodiment of a compression band 10' can be provided that can comprise a supportive back portion 22' and front panels 12', 14' that crisscross to form a surplice 20'. The supportive back portion 22' can comprise a single panel 23 as shown with the single panel 23 secured to the front panels 12', 14' along seams 24. Draw channels 40 can be formed as above with drawstrings 42 at or near the seam 24. In the embodiment shown, each front panel 12', 14' does not extend between the opposing ends of the single panel 23. Instead, each front panel 12', 14' can taper to a seam 36'. In some such embodiments, the front panels 12', 14' can be connected to each other at the intersection of the front panels 12', 14' or along the tapered ends of the front panels 12', 14'. Further, the front panels 12', 14' can be connected near or along the seam 36' where garment body 32 and compression band 10' are secured together.

Referring back to FIGS. 1-6A, the panels 12, 14, 16, 18 of the compression band 10 can comprise the same or different fabric or fabrics. In some embodiments, one or more panels 12, 14, 16, 18 of the compression band 10 can comprise a single fabric. In some embodiments, one or more panels 12, 14, 16, 18 of the compression band 10 can comprise two or more fabrics. In some embodiments, each panel 12, 14, 16, 18 of the compression band 10 can comprise multiple fabric layers.

The fabric or fabrics used to form the front and back panels 12, 14, 16, 18 can vary depending on use. The fabric or fabrics can comprise one or more knit fabrics. The type of knit structure of the fabric can vary as well. In some embodiments, the front and back panels 12, 14, 16, 18 can comprise one or more fabric layers having a weft knit structure and/or one or more fabric layers having a warp knit structure. Each knit fabric can comprise a compression fabric, meaning the fabric has an elasticity that facilitates the creation of a compression force when the compression band 10 in which the fabrics are used are stretched.

The fabric or fabrics can comprise synthetic fibers or synthetic and natural fibers blends. For example, the one or more fabrics can comprise polyester, polypropylene, nylon, acrylic, spandex (or elastane), or the like. In some embodiments, the one or more fabrics can further include cotton, rayon, linen, cashmere, silk, etc. For example, in some embodiments, the one or more fabrics can comprise a knit fabric comprising nylon and spandex.

Figure 7:
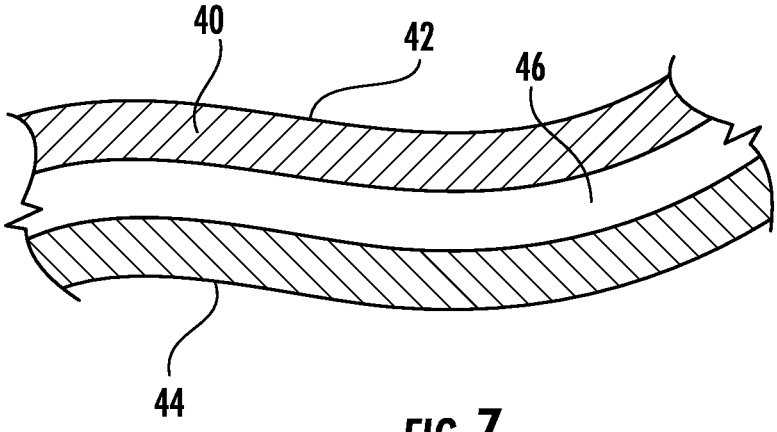
FIG. 7 illustrates a cross-sectional side view of a portion of a panel of an embodiment of a compression band according to the subject matter disclosed herein.

Referring to FIG. 7, a cross-sectional portion 40 of panel, such as panels 12, 14, 16, 18, is shown. In such embodiments, for example, each panel 12, 14, 16, 18 can comprise an outer fabric layer 42 that substantially forms apportion of the outward facing exterior of the compression band 10, a facing fabric layer 44 that substantially forms a portion of the inward facing exterior of the compression band 10 that faces the body of the wearer and an interior fabric layer 46 that is positioned between the outer fabric layer 42 and the facing fabric layer 44. The outer fabric layer 42, the interior fabric layer 46, and the facing fabric layer 44 can comprise one or more knit fabrics. Compression bands, for example, having front panels that comprise such layered fabrics can cradle and support the lower abdomen with a unique curved shape, applied to the outer panel.

In some embodiments, front and back panels 12, 14, 16, 18 can comprise an outer layer 42 and a facing layer 44 (see FIG. 7) that comprise a nylon and spandex high performance warp knit fabric and an interior layer 46 that comprises a warp knit powermesh fabric that can comprise nylon and spandex. For example, in some embodiments, front and back panels 12, 14, 16, 18 can comprise an outer layer 42 and a facing layer 44 that comprise a high performance warp knit fabric that comprises about 80% microfiber nylon and about 20% spandex and an interior layer 46 that comprises a warp knit powermesh fabric that can comprise about 90% nylon and about 10% spandex.

The surplice 20 form by such front panels 12, 14 can cradle and support the lower abdomen with a unique curved shape, applied to the front panels 12, 14. At the same time, each back panel 16, 18 can comprise an outer layer, a facing layer and a thin elastic interior layer, such as a powermesh or a powernet interliner, that extends the entire height of the respective side back panel. By having the facing layer 44 and the outer layer 42 comprise a knit fabric, added benefits inherent in the fabric properties can be recognized, such as extra comfort, body moisture system, quick dry, easy care, wrinkle free and UN protection. By having the interior layer 46 comprise a powermesh inside the front and side back panels, additional support and stability can be added.

In such embodiments, the compression band 10 can comprise three layers of compression fabric in each panel 12, 14, 16, 18. Where the front panels 12, 14 overlap in such embodiments, the compression band 10 can comprise six layers of supportive fabric in total for the wearer. As the pregnancy progresses and the abdomen grows larger, more tension in the fabric can be created, thereby increasing the compression (i.e., pressure) created by the compression band (as measured in pascals or mmHg, for example) and offering added support to the wearer's pelvis and lower belly. Without wishing to be bound by any particular theory, it is contemplated that, in some embodiments, the compression band can create between about 5 mmHg and about 50 mmHg of compression pressure when the fabrics are stretched. In some embodiments, the compression band can create between about 10 mmHg and about 40 mmHg of compression pressure when the fabrics are stretched. In other embodiments, the compression band can create between about 20 mmHg and about 40 mmHg of compression pressure when the fabrics are stretched. To reiterate, the compression bands disclosed herein can be used by men or women who are not pregnant. Additionally, the compression band can be used in garments for men and/or garments for women who are not pregnant as well.

Figures 8A, 8B, 8C:
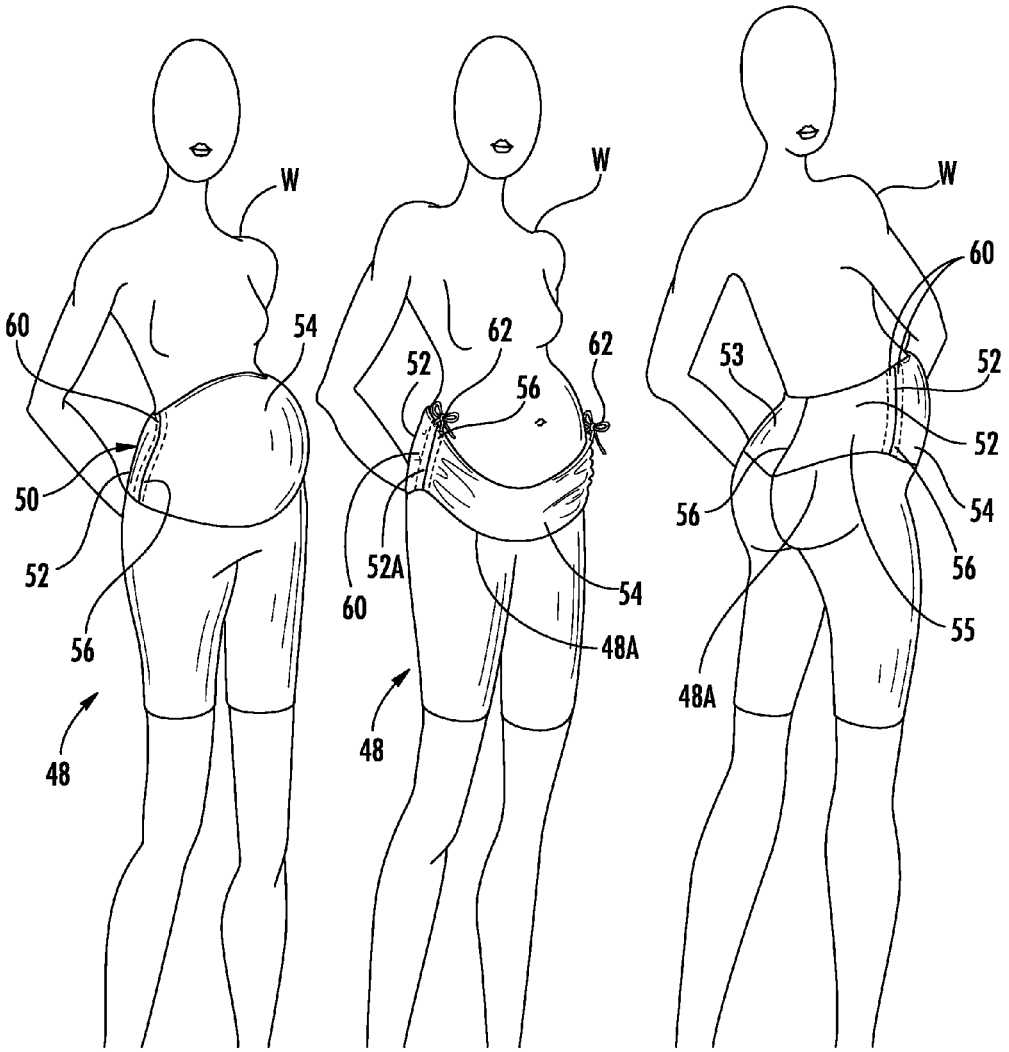
FIG. 8A illustrates a front perspective view of an embodiment of a compression garment that can comprise an embodiment of a compression band with the compression band in an extended position as worn on a wearer according to the subject matter disclosed herein.
FIG. 8B illustrates the front perspective of the embodiment of the compression garment according to FIG. 8A with the compression band in a cradle position as worn on the wearer according to the subject matter disclosed herein.
FIG. 8C illustrates a back perspective view of the embodiment of the compression garment according to FIG. 8A showing a supportive back portion of the compression band when the compression band is in an extended position as worn on the wearer according to the subject matter disclosed herein.

Referring to FIGS. 8A-8C, a wearer W is wearing a compression garment, generally designated 48, that can comprise another embodiment of a compression band, generally designated 50. The compression band 50 is different from the embodiment of compression bands described above. The compression band 50 can comprise a supportive back portion 52 having a first side end 52A and a second side end (not shown in FIGS. 8A-8C, but similar to the back support portion side ends described above) and a single front panel 54 secured along side seams 56 to the first and second ends 52A of the supportive back portion 52. As above, draw channels 60 with a drawstring 62 (see FIG. 8C) therein can be positioned at each of the side 56 between the front panel 54 and the supportive back portion 52. The front panel 54 can thus be adjustable along the draw channels 60 to permit adjustable support and compression along an abdomen of the wearer W.

As shown in FIG. 8C and as described above, the supportive back portion 52 of the compression band can comprise a first back panel 53 and second back panel 55 secured along a center curved back seam 58. In some embodiments, the supportive back portion 52 can be configured to extend above the natural waistline when worn by a wearer W. The benefits of the supportive back portion 52 and the curved back seam 58 are similar to those in the compression bands described above.

In some embodiments, the front panel 54 and/or the back panels 53, 55 can comprise multiple compression fabric layers, similar to those shown in FIG. 7 but possibly having different weights and compression pressures. For example, the front panel 54 and/or the back panels 53, 55 can comprise an outer compression fabric layer, a facing compression fabric layer and an interior compression fabric layer. In some such embodiments, the outer compression fabric layer and the facing compression fabric layer can comprise a high performance warp knit fabric. In particular, in some such embodiments, the front panel 54 and/or the back panels 53, 55 can comprise an outer fabric layer, a facing fabric layer and an interior powermesh fabric layer. Examples of fabrics that can be used for the outer fabric layer and the facing fabric layer can comprise a compression knit fabric comprising about 70% to about 75% nylon and about 25% to about 30% spandex. For instance in one embodiment, the outer fabric layer and the facing fabric layer can comprise a compression knit fabric comprising about 72.5% nylon and about 27.5% spandex. The interior compression fabric layer can comprise a powermesh fabric comprising about 80% nylon and about 20% spandex and weight about 6 oz./yd.$^2$.

As can be seen in FIG. 8A, the front panel 54 can be adjustable to an extended position to provide support and coverage across the front of the abdomen of the wearer W. Similarly, the front panel 54 can be adjustable to a cradle position to form a sling along the lower abdomen of the wearer W to provide support from beneath the abdomen as shown in FIG. 8B. Thereby, the front panel 54 can be adjustable between an extended position and a cradle position while the supportive back portion 52 remains substantially in an extended position to support the mid and lower back of the wearer W and function as a lumbar support. By being adjustable in this manner, the front panel 54 can extend above the natural waistline of the wearer W when the front panel 54 is in the extended position and the front panel 54 can reside below the natural waistline of the wearer W when the front panel 54 is in the cradle position. Additionally, the front panel 54 can be adjusted to some position therebetween.

Figure 9A:
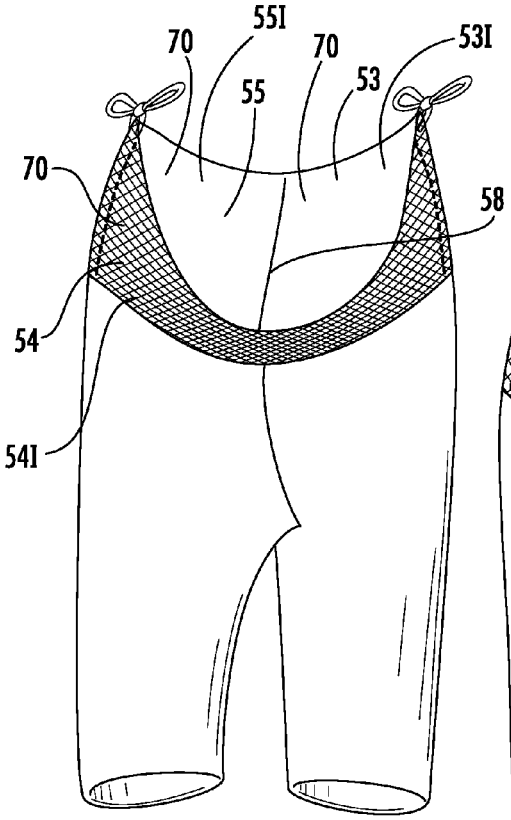
FIG. 9A illustrates a front view of an embodiment of a compression garment that can comprise an embodiment of an interior layer of a compression band according to the subject matter disclosed herein.
Figure 9B:
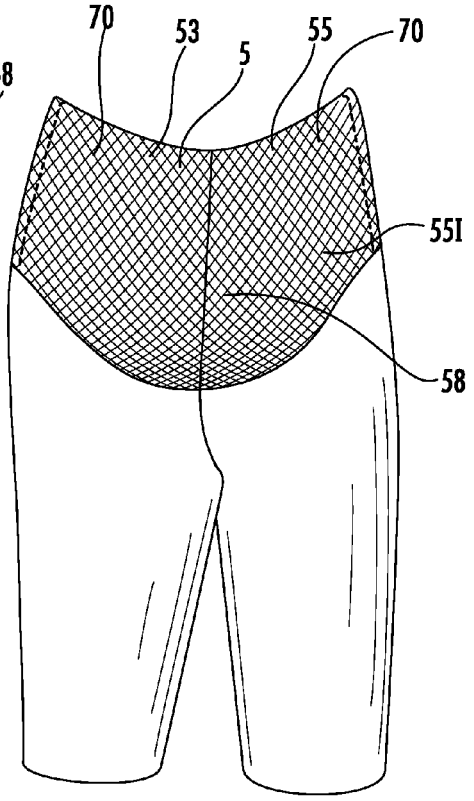
FIG. 9B illustrates a back view of the embodiment of the compression garment according to FIG. 9A showing the interior layer of a supportive back portion of the compression band according to the subject matter disclosed herein.

FIGS. 9A and 9B show an example of a construction of the interior layer 70 of the front and back panels 53, 54, 55 of the compression band 50. As can be seen FIG. 9B, the interior layers 53I, 55I of the back panels 53, 55 in some embodiments can extend at least proximate to the length and width of the back panel 54. In some embodiments as shown in FIG. 9A, the interior compression fabric layer 54I of the front panel 54 can have a two dimensional shape that is different from the shapes of the outer compression fabric layer and the facing compression fabric layer (not shown in FIGS. 9A and 9B) of the front panel 54. The two dimensional shape can be geometric. In particular, the shape of the interior compression fabric layer 54I can provide added cradling support under a belly of a wearer without added compression on the belly itself. For example, the shape of the interior compression fabric layer 54I can comprise a U-shaped recess within the interior compression fabric layer 54I to provide added cradling support under a belly of a wearer.

In the embodiments shown in FIGS. 8A-9B, more tension in the fabric can be created as the outer fabric layers and the interior fabric layer are stretched, thereby, increasing the compression (i.e., pressure) created by the compression band (as measured in pascals or mmHg, for example) and offering added support to the wearer's pelvis and lower belly. Without wishing to be bound by any particular theory, it is contemplated that, in some embodiments similar to those shown in FIGS. 8A-9B, the compression band can create between about 5 mmHg and about 40 mmHg of compression pressure when the fabrics are stretched. In some embodiments, the compression band can create between about 10 mmHg and about 30 mmHg of compression pressure when the fabrics are stretched. In other embodiments, the compression band can create between about 15 mmHg and about 20 mmHg of compression pressure when the fabrics are stretched. Thereby, the compression bands shown in FIGS. 8A-9B and maternity garments in which they can be employed can provide additional support as the pregnancy of the wearer progresses and the abdomen grows larger. Alternatively, the compression bands disclosed herein can be used by men or women who are not pregnant. Additionally, the compression band can be used in garments for men and/or garments for women who are not pregnant to provide support to abdomen area of a man or a woman who is not pregnant when wearing the compression bands or the garments that have such compression bands therein.

As above, the compression band 50 shown in FIGS. 8A-9B can be secured to the garment body 48 along a seam 48A. In particular, the compression band 50 can be secured to the garment body to form a waistline portion of the garment. The garment body 48 can, of course, comprise support leggings, support shorts, swimwear, skirts, shorts, pants, and/or underpants.

Figure 10A:
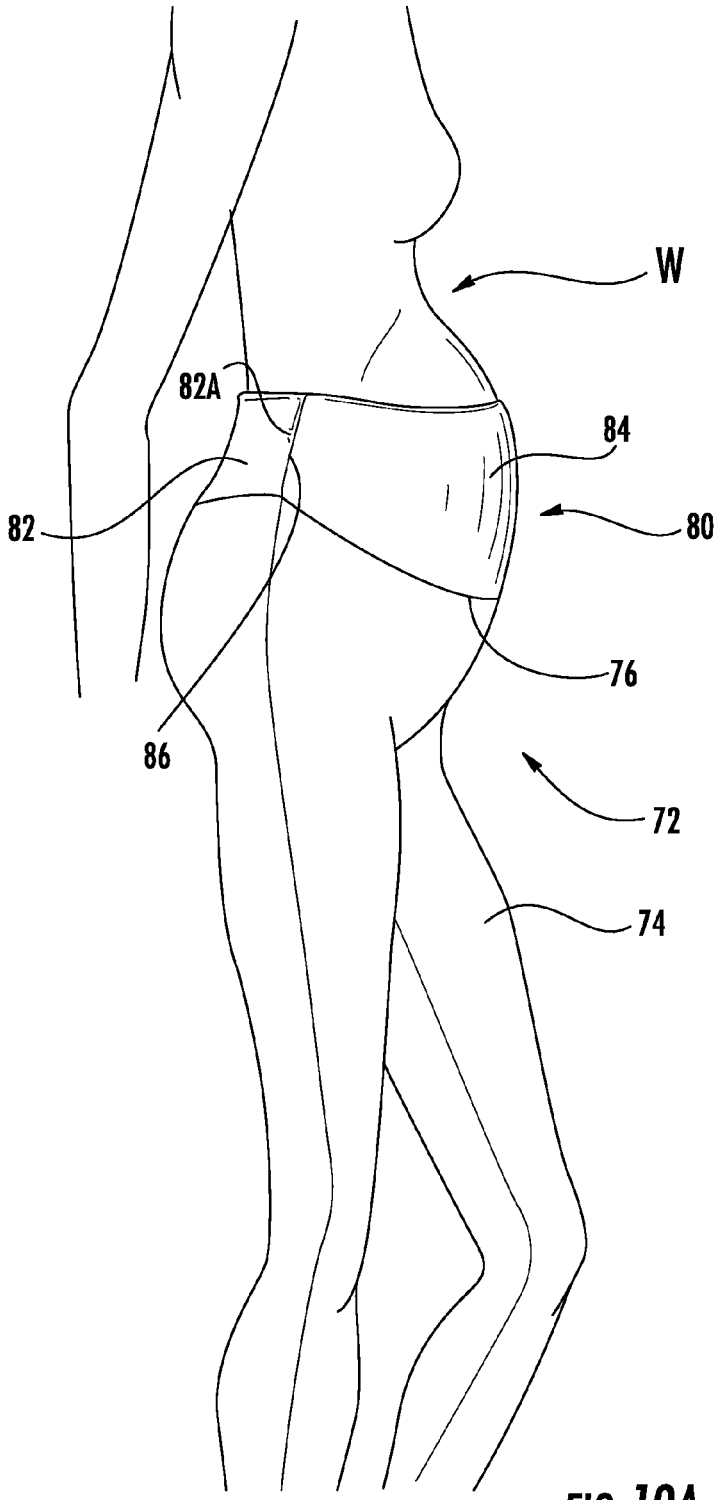
FIG. 10A illustrates a side view of an embodiment of a compression garment that can comprise an embodiment of a compression band having a supportive interior layer without the need for drawstrings according to the subject matter disclosed herein.
Figure 10B:
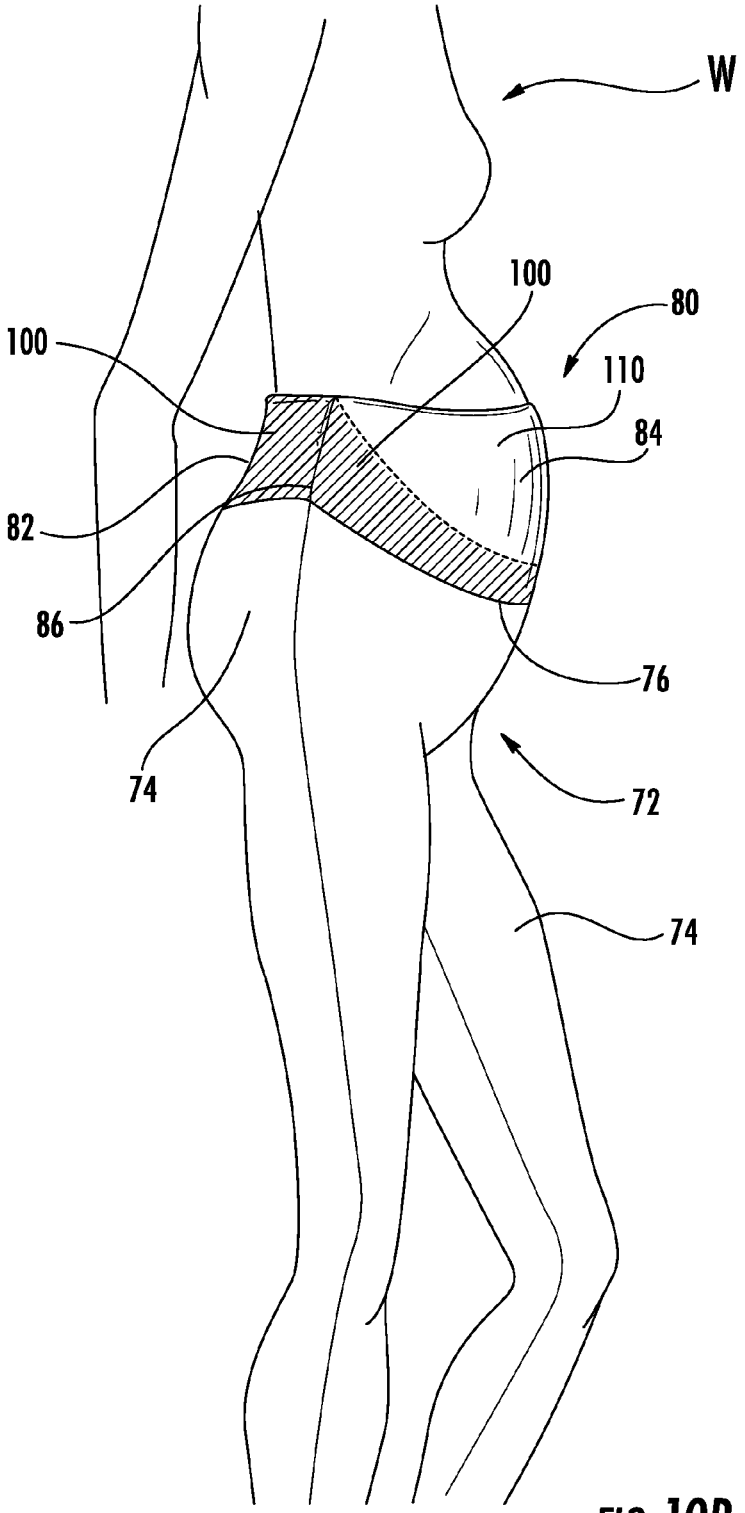
FIG. 10B illustrates a back view of the embodiment of the compression garment according to FIG. 10A showing the supportive interior layer of a supportive back portion and the front portion of the compression band according to the subject matter disclosed herein.

Referring to FIGS. 10A and 10B, an embodiment of a different compression band garment, generally designated 72, is provided can comprise a garment body 74 and a compression band, generally designated 80, having a configuration without drawstrings. As shown in FIGS. 10A and 10B, a wearer W is wearing the compression garment 72 with the compression band 80 around waist line of the wearer W. The compression band 80 is similar to, but different from the embodiment of compression bands referenced in FIGS. 8A-9B. The compression band 50 can comprise a supportive back portion 82 having a first side end 82A and a second side end (not shown in FIGS. 10A and 10B) and a single front panel 84 secured along side seams 86 to the first and second ends 82A of the supportive back portion 82. In some embodiments, the supportive back portion may be a single panel. In some embodiments, similar to the embodiments described above, the supportive back portion 82 of the compression band can comprise a first back panel and second back panel secured along a center curved back seam. In some embodiments, the supportive back portion 82 can be configured to extend above the natural waistline when worn by a wearer W. The benefits of the embodiments that include the supportive back portion 82 that include a curved back seam (not shown in FIGS. 10A-10B) are similar to those in the compression bands described above.

Figure 11A:
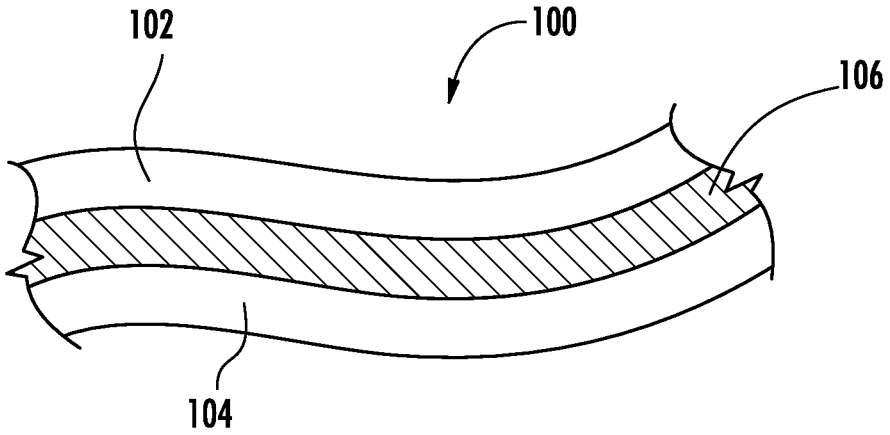
FIG. 11A illustrates a cross-sectional side view of a portion of a panel of an embodiment of a compression band according to the compression band used in the garment according to FIGS. 10A and 10B.

In the embodiment shown in FIGS. 10A and 10B, no drawstring or drawstring channels are present in the compression band 80. To provide support and the desired compression, the front panel 84 and/or the panels of the back portion 82 can comprise multiple compression fabric layers, similar to those shown in FIG. 7 but possibly having different weights and compression pressures. In other preferred embodiments, the front panel 84 and/or the panels of the back portion 82 can comprise an outer fabric layer, a facing fabric layer and an interior compression fabric layer. In some preferred embodiments, front panel 84 and/or the panels of the back portion 82 can comprise compression panels having stretch outer fabric layer, a stretch facing fabric layer and an interliner compression fabric layer between the outer fabric layer and the facing fabric layer. The interliner compression fabric layer can provide the compression at specific locations along the compression band to provide specific support at specific locations on the wearer. The configuration of the compression band so that it provides specific support at specific locations on the wearer will be explained in more detail with reference to FIGS. 10A and 10B as well as FIGS. 11A and 11B.

As shown in FIGS. 10A-11B, the front panel 84 and/or the panels of the back portion 82 can comprise different panel portions that can provide different compression support within those portions. Portions 100 of the panels 82, 84 can provide a more intensive compression support than portions 110 of the panels 82, 84 at the location on the wearer W where the portions 100 of the panels 82, 84 reside. As shown in FIG. 11A, the portions 100 of the panels 82, 84 can comprise an outer fabric layer 102, a facing fabric layer 104 and an interliner, or interior, compression fabric layer 106. In some embodiments, the outer fabric layer 102 and the facing fabric layer 104 can comprise a knit fabric. For example, the outer fabric layer 102 and the facing fabric layer 104 can comprise a weft knit fabric, such as a circular knit fabric or a flat knit fabric, or a warp knit fabric, such as trichot knit fabric or a Milanese knit fabric. For example, the outer fabric layer 102 and the facing fabric layer 104 can comprise a stretch fabric that allows stretching but does not provide as much compression as the interliner, or interior, compression fabric layer 106. For example, the outer fabric layer 102 and the facing fabric layer 104 can comprise a circular knit fabric such having a jersey knit or ribbed knit construction that comprises at least one yarn with exception elasticity such as spandex used in combination with other yarns comprising such fibers as cotton, polyester, nylon, or the like.

The interior compression fabric layer 106 can also comprise a knit fabric, but one that provides a greater compression force that the outer fabric layer 102 and the facing fabric layer 104. For example, the interior compression fabric layer 106 can comprise a high performance warp knit fabric. In some embodiments, the interior compression fabric layer 106 can comprise a powermesh fabric. For example, in some embodiments, the powermesh fabric can comprise about 80% nylon and about 20% spandex and weight about 6 oz./yd.$^2$.

Figure 11B:
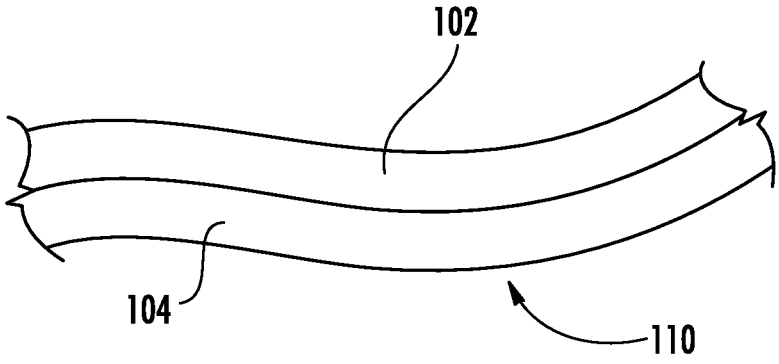
FIG. 11B illustrates a cross-sectional side view of another portion of a panel of an embodiment of a compression band according to the compression band used in the garment according to FIGS. 10A and 10B, Repeat use of reference characters in the present specification and drawings is intended to represent the same or analogous features or elements of the invention.

As shown in FIGS. 10A and 11B, the portions 100 of the panel 84 can comprise the outer fabric layer 102 and the facing fabric layer 104. By not having the interliner, or interior, compression fabric layer 106 within the portions 100 of the panel 84, the portions 100 of the panel 84 provide much less compression than the portions 110 of the panels 82, 84 that have the interliner, or interior, compression fabric layer 106. Thereby, the compression band can have compression support zones where the portions 110 of the panels reside and stretch zones that provide less compression support where the portions 100 of the panels reside. In this manner, the compression band can be engineered to provide compression support at designated locations within the compression band while providing coverage, but much less support at other designated locations within the compression band. In this manner, a wearer that uses the compression bands with designated compression support zones and designated stretch zones, or garments that comprise such a compression band, can have coverage support provided to certain areas of the wearer's body and coverage with less support in other areas of the wearer's body.

For example, as shown in FIG. 10A, a compression support zone of the compression band 80 is provided in the portions 110 of the panels 82, 84 and a stretch zone of the compression band 80 is provided in the portions 100 of the panel 84 where less support is needed. In particular, the embodiment shown, compression support zone with the portions 110 of the panels 82, 84 of the compression band 80 can be positioned within the compression band 80 to provide support to the back and under and around the lower portion of the belly of the wearer W where more support may be needed. In particular, the interior compression fabric layer 106 of the front panel 84 can have a two dimensional shape that is different from the shapes of the outer fabric layer 102 and the facing fabric layer 104 of the front panel 84.

Thereby, the portions 110 of the panel 84 are formed that creates a stretch zone that provides cover but less compression support than the compression support zone of the compression band 80. In particular, the shape of the interior compression fabric layer 106 can provide added cradling support under a belly of a wearer without added compression on the belly itself within the compression support zone. For example, the shape of the interior compression fabric layer 106 can comprise a U-shaped recess within the interior compression fabric layer 106 to provide added cradling support under a belly of a wearer. Other configurations of portions 110 and portions 100 of the compression band 80 can be made to provide different compression support zones and stretch zones within the compression so that the wearer can achieve support within different and specific locations on the wearers body. For example, In some embodiments, the compressive pressure (or force) created by the stretch zones can be between about 10% and about 70% of the compressive pressure (or force) created by the compression support zones when stretched the substantially the same amount. In some embodiments, the compressive pressure created by the stretch zones can be about 50% or less of the compressive pressure created by the compression support zones when stretched the substantially the same amount.

In the embodiments shown in FIGS. 10A and 10B, more tension in the fabric can be created as the interliner, or interior, compression fabric layers 106 are stretched, thereby, increasing the compression (i.e., pressure) created by the compression band (as measured in pascals or mmHg, for example) and offering added support to the wearer's pelvis and lower belly. Without wishing to be bound by any particular theory, it is contemplated that, in some embodiments similar to those shown in FIGS. 10A and 10B, the compression band can create between about 5 mmHg and about 40 mmHg of compressive pressure within the compression band when the fabrics are stretched. In some embodiments, the compression band can create between about 10 mmHg and about 30 mmHg of compressive pressure when the fabrics are stretched. In other embodiments, the compression band can create between about 15 mmHg and about 20 mmHg of compressive pressure when the fabrics are stretched. Differences in compressive pressures between Thereby, the compression bands shown in FIGS. 10A and 10B and maternity garments in which they can be employed can provide additional support as the pregnancy of the wearer progresses and the abdomen grows larger. Alternatively, the compression bands similar to those shown in FIGS. 10A and 10B can be used by men or women who are not pregnant. Additionally, the compression bands can be used in garments for men and/or garments for women who are not pregnant to provide support to abdomen area of a man or a woman who is not pregnant when wearing the compression bands or the garments that have such compression bands therein.

As above, within the garment 72, the compression band 80 shown in FIGS. 10A and 10B can be secured to the garment body 74 along a seam 76. In particular, the compression band 80 can be secured to the garment body 74 to form a waistline portion of the garment. The garment 72 can, of course, comprise support leggings, support shorts, swimwear, skirts, shorts, pants, and/or underpants.

Thus, as disclosed herein, a compression band can be provided that can comprise an outer fabric layer, a facing fabric layer, and an interior compression fabric layer. In such compression bands, portions of the compression band can comprise the outer fabric layer, the facing fabric layer and the interior compression fabric layer to form one or more compression support zones and portions of the compression band can comprise the outer fabric layer and the facing fabric layer within no interior compression fabric layer to form one or more stretch zones within the front panel. The one or more stretch zones of the front panel create less compressive pressure when stretched than the compressive pressure created within the one or more compression support zones of the compression band when stretch by substantially the same amount. For example, in some embodiments, the compressive pressure created by the stretch zones can be about 75% or less of the compressive pressure created by the compression support zones when stretched the substantially the same amount. In some embodiments, the compressive pressure created by the stretch zones can be about 50% or less of the compressive pressure created by the compression support zones when stretched the substantially the same amount. In some embodiments, the compressive pressure created by the stretch zones can be about 30% or less of the compressive pressure created by the compression support zones when stretched the substantially the same amount.

For example, in some embodiments, the compressive pressure created by the stretch zones can be between about 8 mmHg and about 15 mmHg, while the compressive pressure created by the compression support zones can be between about 20 mmHg and about 40 mmHg when stretched the substantially the same amount. In some embodiments, the compressive pressure created by the stretch zones can be about 15 mmHg, while the compressive pressure created by the compression support zones can be about 20 mmHg when stretched the substantially the same amount. In some embodiments, the compressive pressure created by the stretch zones can be about 15 mmHg, while the compressive pressure created by the compression support zones can be about 30 mmHg when stretched the substantially the same amount. In some embodiments, the compressive pressure created by the stretch zones can be about 8 mmHg, while the compressive pressure created by the compression support zones can be about 30 mmHg when stretched the substantially the same amount.

In some embodiments as disclosed herein, a compression band can comprise a supportive back portion having a first side end and a second side end and a front panel secured along side seams to the first and second ends of the supportive back portion. The front panel can comprise an outer fabric layer, a facing fabric layer and an interior compression fabric layer such that portions of the front panel can include the outer fabric layer, the facing fabric layer and the interior compression fabric layer to form one or more compression support zones within the front panel and portions of the front panel include the outer fabric layer and the facing fabric layer without any interior compression fabric layer to form one or more stretch zones within the front panel. The one or more stretch zones of the front panel creates less compressive pressure when stretched than the compressive pressure created within the one or more compression support zones of the front panel when stretch by substantially the same amount.

The supportive back portion of such embodiments can comprise a first back panel and second back panel secured along a center curved back seam and the back panels comprise an outer fabric layer, a facing fabric layer and an interior compression fabric layer. In some embodiments, the back panels can also have portions that can include the outer fabric layer, the facing fabric layer and the interior compression fabric layer to form one or more compression support zones within the respective back panel and portions that can include the outer fabric layer and the facing fabric layer without the interior compression fabric layer to form one or more stretch zones within the respective back panel. In some embodiments, the stretch zones can comprise the outer fabric layer and the facing fabric layer without any of the interior compression fabric layer therein.

In particular, in some embodiments, the interior compression fabric layer can have a two dimensional shape that is different from the shapes of the outer fabric layer and the facing fabric layer of the front panel. The shape of the interior compression fabric layer can create the one or more compression support zones where the outer fabric layer, the interior compression fabric layer and the facing fabric layer reside and the one or more stretch zones where the outer fabric layer and the facing fabric layer reside without the interior compression fabric layer. For example, the shape of the interior compression fabric layer can comprise a U-shaped recess within the interior compression fabric layer to provide added cradling support under a belly of a wearer. In such embodiments, draw channels with a drawstring therein can be provided that are positioned at each of the side seams between the front panel and the supportive back portion. In this manner, the front panel can also be adjustable along the draw channels to permit adjustable support and compression along an abdomen of a wearer.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A compression band comprising:

a band comprising:

a supportive back portion having a first side end and a second side end;

a front panel secured along side seams to the first and second ends of the supportive back portion;

wherein the supportive back portion comprise a first back panel and second back panel secured along a center curved back seam and at least one of the front panel or the back panels comprises multiple fabric layers; and draw channels with a drawstring therein positioned at each of the side seams between the front panel and the supportive back portion with the draw channels positioned along the side seams, the front panel being adjustable along the draw channels to permit adjustable support and compression along an abdomen of a wearer.

2. The compression band according to claim 1, wherein at least one of the front panel or the back panels comprises an outer fabric layer, a facing fabric layer and an interior compression fabric layer.

3. The compression band according to claim 1, wherein at least one of the front panel or the back panels comprises an outer fabric layer, a facing fabric layer and an interior powermesh fabric layer.

4. The compression band according to claim 1, wherein the front panel is adjustable between an extended position configured to provide support and coverage across the front of the abdomen of the wearer and a cradle position configured to form a sling along the lower abdomen of the wearer to provide support from beneath the abdomen while the supportive back portion remains substantially in an extended position to support a mid and lower back of the wearer and function as a lumbar support.

5. The compression band according to claim 4, wherein the front panel is configured to extend above a natural waistline of the wearer when the front panel is in the extended position and the front panel resides below the natural waistline of the wearer when the front panel is in the cradle position.

6. The compression band according to claim 1, wherein the front panel comprises an outer fabric layer, a facing fabric layer and an interior compression fabric layer and the interior compression fabric layer has a two dimensional shape that is different from shapes of the outer compression fabric layer and the facing compression fabric layer of the front panel, the shape of the interior compression fabric layer configured to provide added cradling support under a belly of a wearer.

7. The compression band according to claim 6, wherein the shape of the interior compression fabric layer configured to provide added cradling support under a belly of a wearer comprises a U-shaped recess within the interior compression fabric layer configured to provide added cradling support under a belly of a wearer.

8. The compression band according to claim 1, wherein the front panel comprises a first front panel secured along the side seam to the first end of the supportive back portion and a second front panel secured along the side seam to the second end of the supportive back portion, the first front panel and the second front panel crisscrossing to form a surplice.

9. The compression band according to claim 8, wherein the front panels comprises an outer compression fabric layer, a facing compression fabric layer and an interior compression fabric layer and the front panels provide six supportive fabric layers where the first and second front panels overlap.

10. The compression band according to claim 8, wherein the surplice formed by the first and second front panels is configured to be adjusted between an upper extended position and a lower cradle position while the supportive back portion remains substantially in an extended position configured to support a mid and lower back of the wearer and function as a lumbar support.

11. A compression garment comprising the compression band according to claim 1.

12. A compression band comprising:

a band comprising:

a supportive back portion having a first side end and a second side end; and a front panel secured along side seams to the first and second ends of the supportive back portion, the front panel comprising an outer fabric layer, a facing fabric layer and an interior compression fabric layer such that portions of the front panel include the outer fabric layer, the facing fabric layer and the interior compression fabric layer to form one or more compression support zones within the front panel and portions of the front panel include the outer fabric layer and the facing fabric layer without the interior compression fabric layer therein to form one or more stretch zones within the front panel; and the one or more stretch zones of the front panel creating less compressive pressure when stretched than the compressive pressure created within the one or more compression support zones of the front panel when stretched by substantially the same amount.

13. The compression band according to claim 12, wherein the supportive back portion comprise a first back panel and second back panel secured along a center curved back seam and the back panels comprise an outer fabric layer, a facing fabric layer and an interior compression fabric layer.

14. The compression band according to claim 1, wherein the interior compression fabric layer has a two dimensional shape that is different from shapes of the outer fabric layer and the facing fabric layer of the front panel, the shape of the interior compression fabric layer creating the one or more compression support zones where the outer fabric layer, the interior compression fabric layer and the facing fabric layer reside and the one or more stretch zones where the outer fabric layer and the facing fabric layer reside without the interior compression fabric layer.

15. The compression band according to claim 14, wherein the shape of the interior compression fabric layer comprises a U-shaped recess within the interior compression fabric layer to provide added cradling support under a belly of a wearer.

16. A compression garment comprising the compression band according to claim 12.

17. A method of making a compression garment, the method comprising:

forming a supportive back portion of a compression band;

securing a front panel to the supportive back portion at a first side end and a second side end of the supportive back portion along side seams, so that the front panel and a supportive back portion form the compression band; and forming draw channels on the compression band with a drawstring therein at each of the side seams between the first and second front panels and the supportive back portion;

providing a garment body; and securing the compression band to the garment body.

18. The method according to claim 17, further comprising forming the front panel by securing an outer fabric layer, a facing fabric layer and an interior powermesh fabric layer together.

19. The method according to claim 18, further comprising forming the interior powermesh fabric layer to have a U-shaped recess within the interior compression fabric layer that is configured to provide added cradling support under a belly of a wearer.

* * * * *